US005827107A

United States Patent [19]

Bears et al.

[11] Patent Number: 5,827,107

[45] Date of Patent: Oct. 27, 1998

[54] SPINNING DANCING TOP

[76] Inventors: James Bears, 8870 Cicero Dr., Boynton Beach, Fla. 33437; Chee-Yin Lu, 7817 LaGuardia Dr., Plano, Tex. 75025

[21] Appl. No.: 787,767

[22] Filed: Jan. 28, 1997

[51] Int. Cl.[6] ..... A63H 1/08; A63H 1/00; A63H 27/127

[52] U.S. Cl. ..... 446/263; 446/40; 446/259; 446/264

[58] Field of Search ..... 446/40, 41, 259, 446/261, 262, 263, 264

[56] References Cited

U.S. PATENT DOCUMENTS

| | | | |
|---|---|---|---|
| 253,702 | 2/1882 | Hill | 446/263 |
| 271,428 | 1/1883 | Dannhorn | 446/264 |
| 696,990 | 4/1902 | Mettler | 446/41 |
| 867,373 | 10/1907 | Hoen | 446/264 |
| 1,144,938 | 6/1915 | Howard | 446/263 |
| 1,207,200 | 12/1916 | Novak | 446/264 |
| 1,509,436 | 9/1924 | Marx | 446/264 |
| 1,630,348 | 5/1927 | Mallard | 446/264 |
| 4,455,781 | 6/1984 | Blumenthal | 446/241 |
| 4,480,400 | 11/1984 | diDonato | 46/64 |
| 4,952,189 | 8/1990 | Barlow | 446/241 |
| 5,259,806 | 11/1993 | Chang | 446/270 |
| 5,525,086 | 6/1996 | Gentile et al. | 446/41 |

FOREIGN PATENT DOCUMENTS

| | | | |
|---|---|---|---|
| 520594 | 3/1931 | Germany | 446/263 |
| 50730 | 9/1935 | Germany | 446/264 |
| 155638 | 12/1920 | United Kingdom | 446/263 |

*Primary Examiner*—Robert A. Hafer
*Assistant Examiner*—Laura Fossum
*Attorney, Agent, or Firm*—Ronald G. Bitner

[57] ABSTRACT

A spinning figurine toy has a weighted skirt or disc to provide angular momentum, a lower spindle, a spring attached to the lower spindle, a foot inserted into the lower end of the spring, and a rod fixed in the foot and able to move vertically within the lower spindle. When the toy is spun upon the foot, bouncing or jumping motion may be imparted to the toy by dropping it from a height because of the resilient nature of the spring. A pull-string operated hand launcher having a helical spindle on top fits into a corresponding helical aperture in the foot to provide a means of setting the toy in motion at high speed and of releasing it.

5 Claims, 14 Drawing Sheets

SPINNING DANCING TOP

BACKGROUND OF THE INVENTION

Field of the Invention

This invention relates to a spinning toy for use by children.

SUMMARY OF THE INVENTION

Dreidels and spinning toys such as tops are well known children's playthings. The present invention improves on these by adding a bouncing, jumping and/or dancing action to the top.

BRIEF DESCRIPTION OF THE DRAWINGS

The invention will be described with reference to the accompanying figures, in which.

DESCRIPTION OF THE PREFERRED EMBODIMENTS

Figure 1:
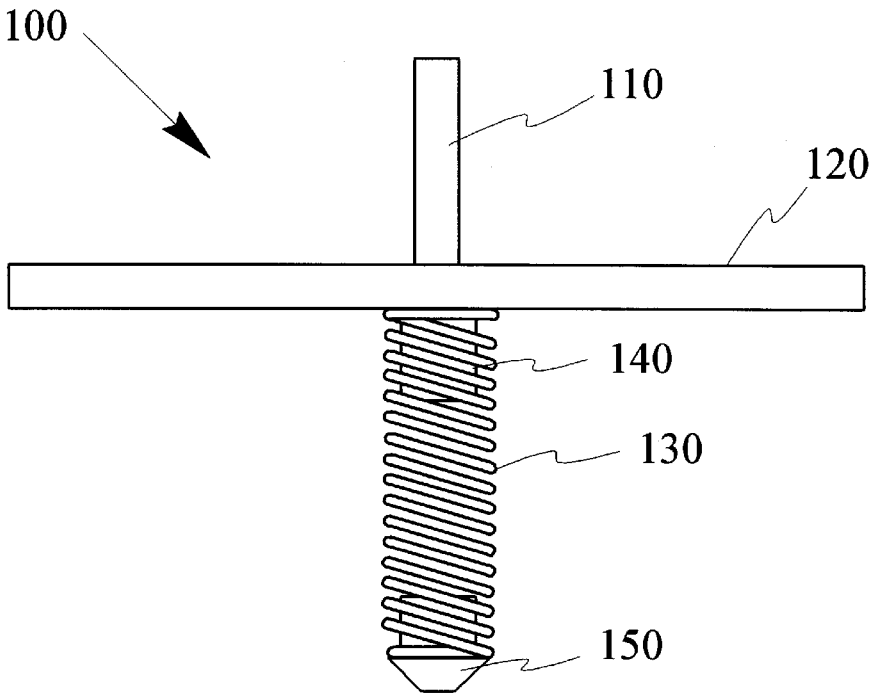
FIG. 1 is a perspective view of a simplified embodiment of the invention.

The toy generally designated as 100 consists in its simplest embodiment of a central spindle portion 110, a disc portion 120, a spring portion 130, and a lower spindle portion 140. The spring is attached to the lower spindle portion by inserting the lower spindle portion into the upper portion of the spring, so that a substantial portion of the spring projects downwardly, free of the lower spindle portion. A foot 150 may be provided in the lower portion of the spring, though not necessary for the functioning of the toy.

The lower spindle portion, the upper spindle portion and the disc are integrally formed into a top. When the toy is spun by applying a rotational force to the upper spindle portion, the bottom of the spring (or alternatively the foot 150 if provided) acts as the pivot point upon the surface upon which the toy is used. Because of the resilient nature of the spring, bouncing or jumping motion may be imparted to the toy by dropping it from a height.

Figure 2:
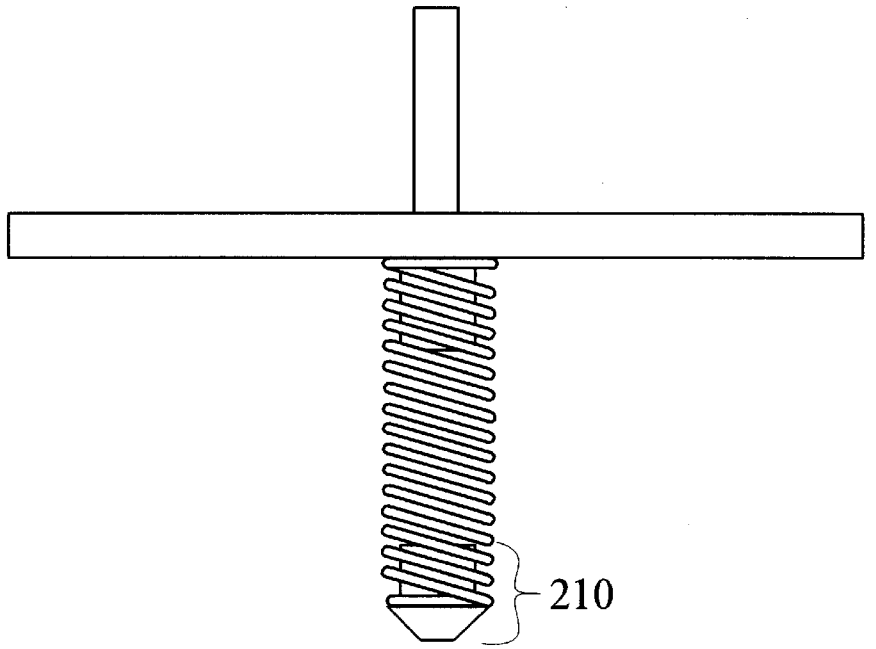
FIG. 2 is a perspective view of a simplified embodiment of the invention incorporating a bump to make the toy jump.
Figure 3:
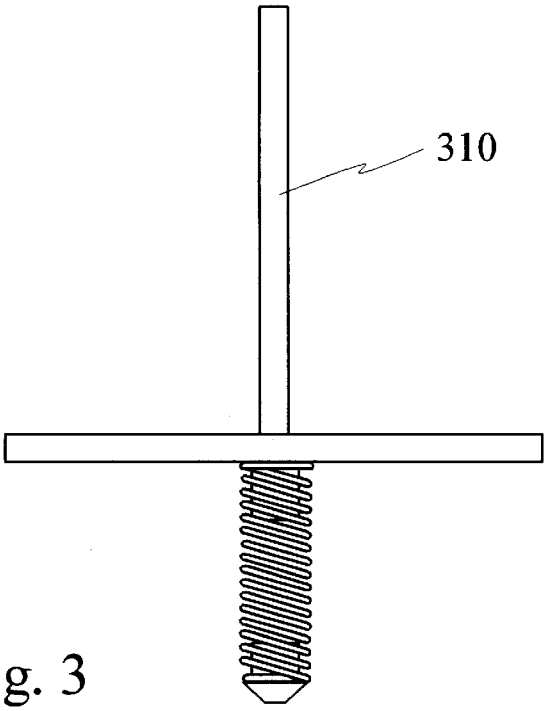
FIG. 3 is a perspective view of a simplified embodiment of the invention incorporating an upper stick to enable the toy to be more easily spun, particularly by small children.
Figure 4:
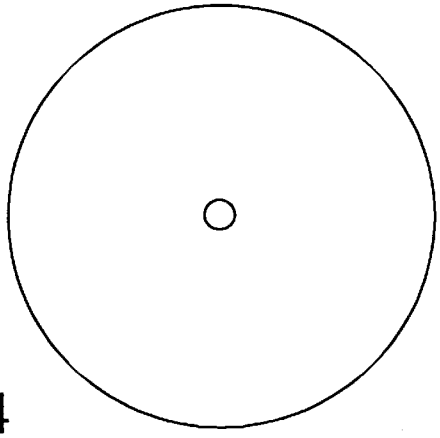
FIG. 4 is a top view of the disk of the invention.
Figure 5:
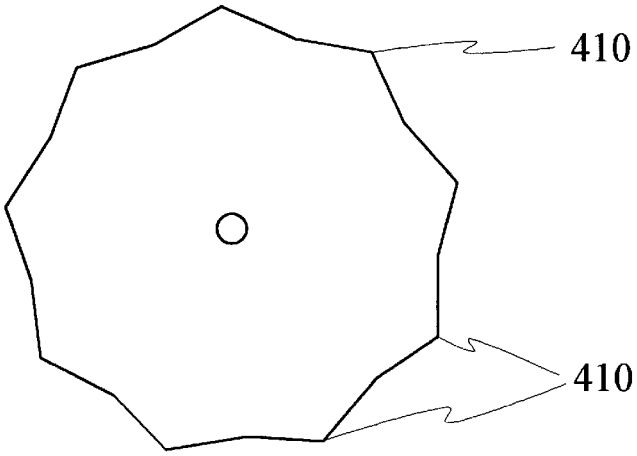
FIG. 5 is a top view of the disk of a modified embodiment of the invention.
Figure 6:
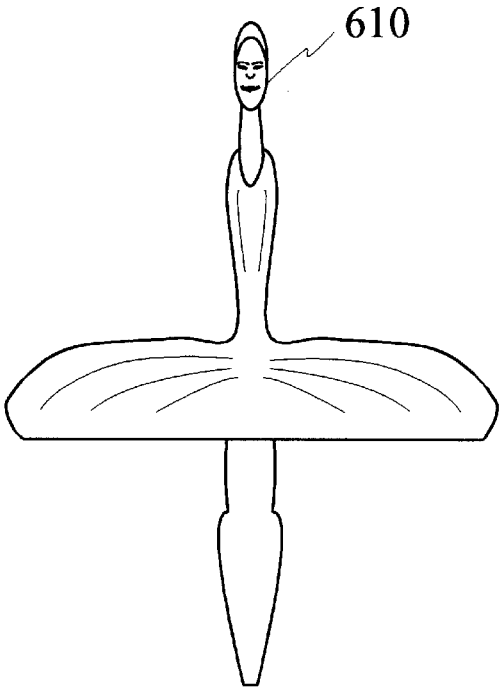
FIG. 6 is an elevation view of a preferred embodiment of the invention.
Figure 7:
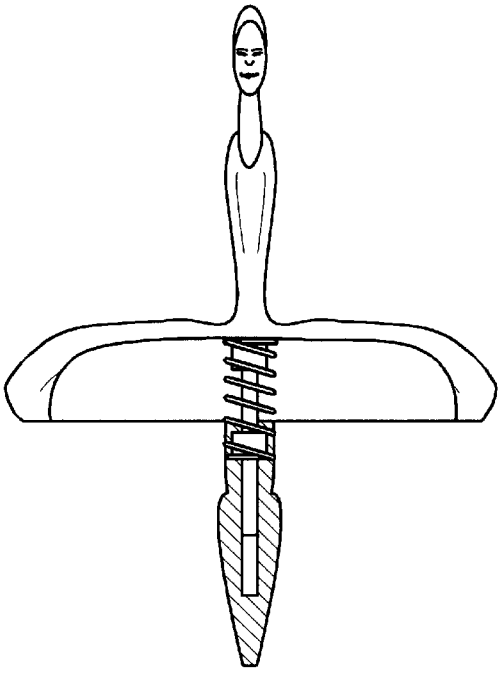
FIG. 7 is an elevation view partly in section of the preferred embodiment of the invention of FIG. 6.
Figure 8:
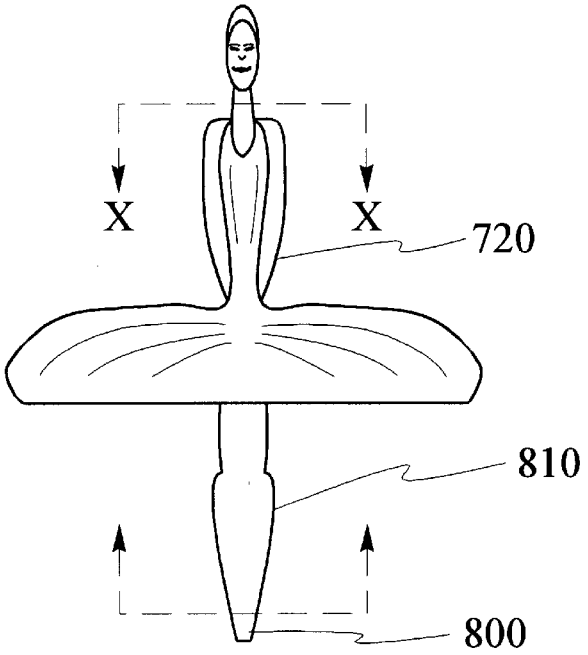
FIG. 8 is an elevation view of the preferred embodiment of the invention of FIG. 6, including arms which fit in slots in the side of the stick figurine and which may swing out under centrifugal force.
Figure 9:
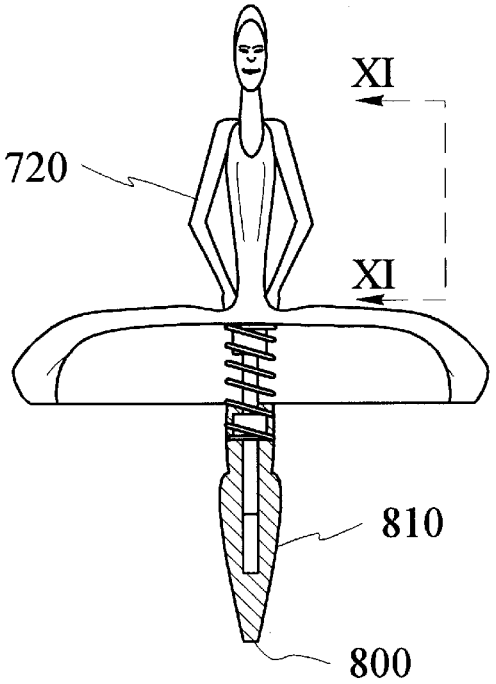
FIG. 9 is an elevation view partly in section of the preferred embodiment of the invention of FIG. 8.
Figure 10A:
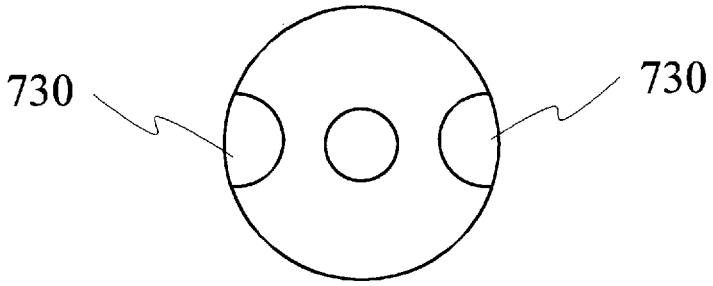
FIG. 10*a* is a top section view taken along the lines 10–10 in FIG. 8, showing the cross-section of the figurine without arms in place.
Figure 10B:
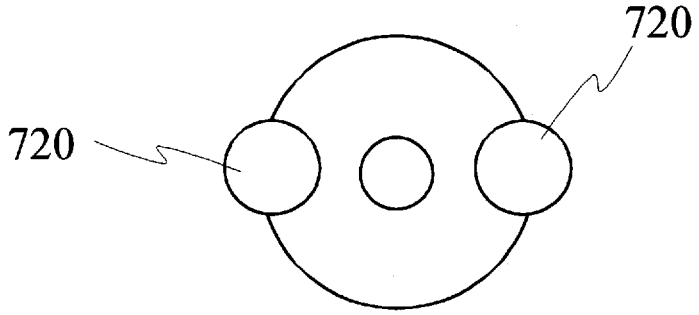
FIG. 10*b* is a top section view taken along the lines 10–10 in FIG. 8, showing the cross-section of the figurine with arms in place.
Figure 11:
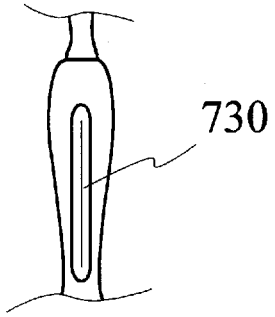
FIG. 11 is a side elevation view as seen along lines 11–11 in FIG. 9, showing the slot 730 in the torso of the Figurine but without arms.
Figure 12:
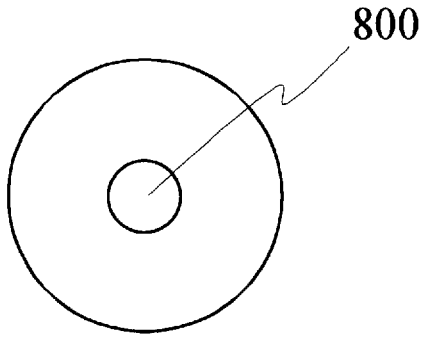
FIG. 12 is a bottom view of the foot 810 of the preferred embodiment of FIGS. 6 through 9.

By providing a small bump 210 on the lower portion of the spring as shown in FIG. 2, extra hopping motion may be imparted to the toy when the toy is spun at a sufficiently nonperpendicular angle to the surface, by striking the surface once per rotation. This causes the toy to simulate the motion of a ballet dancer leaping into the air.

In all of the embodiments shown in this application, if the lower spring is long enough, the toy may be spun by rolling the lower spring between the user's hands. This process may be enhanced by covering or wrapping the spring with a flexible tubular membrane to enhance the friction and feel of the spring for this purpose.

A novel means of spinning the top may be added in the form of an elongated small diameter stick 310 which projects roughly a hands width from the centre point of the disk. The stick can be rubbed between the hands and given a high degree of spin. This is the same principle used to launch propeller toys with the dangling stick. It is the same motion used to spin a stick to generate heat to light a fire.

I have found that rubbing the stick between the hands gives the top a faster spin. Also, I have found that it is easier for young children to spin a heavy top by rubbing the stick between their hands than by attempting to spin the top with their fingers. The fingers are much weaker than the hands.

Protrusions 410 may be put onto the outer rim of the disk of the top in order to allow the tops to engage in a kind of combat with each other. Two spinning tops having protrusion on the rim (see drawing) will strike each other when they contact and the energy released by the hitting protrusions will tend to throw the tops apart.

The stick may be fashioned into a FIG. 610 as shown in FIG. 610. If the figure is of small diameter and of more or less circular cross-section, then it can be used effectively to spin the top by rubbing it between the hands. As well, arms 720 may be provided in slots 730 in the body of the figure. When the body is spun between the hands, the arms will remain in the slots of the stick and will not interfere with the imparting of spin to the top. When the top is placed on the surface, centrifugal force will then cause the arms to move out of their slots. Arms are desirable to give the figure on the top a more natural look. Otherwise the figurine will appear to have no arms.

Figure 13A:
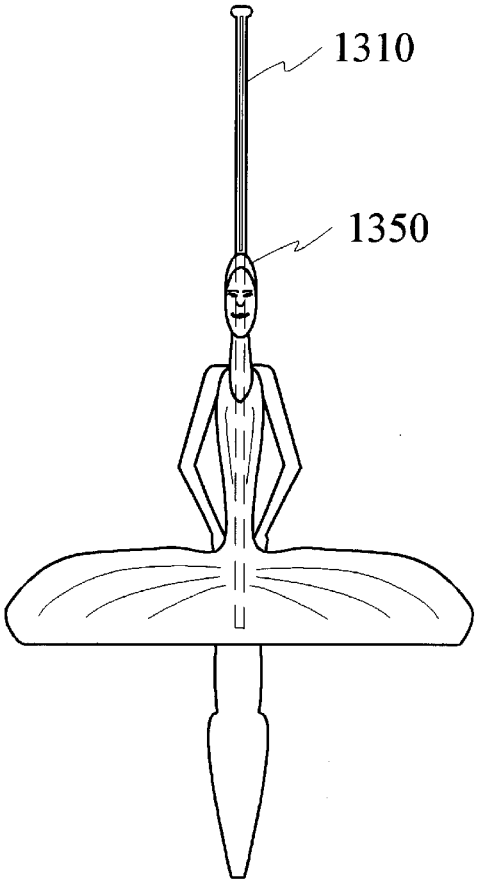
FIG. 13*a* is a side elevation view of another preferred embodiment of the invention, showing the stick protruding from the head of the figurine.
Figure 13B:
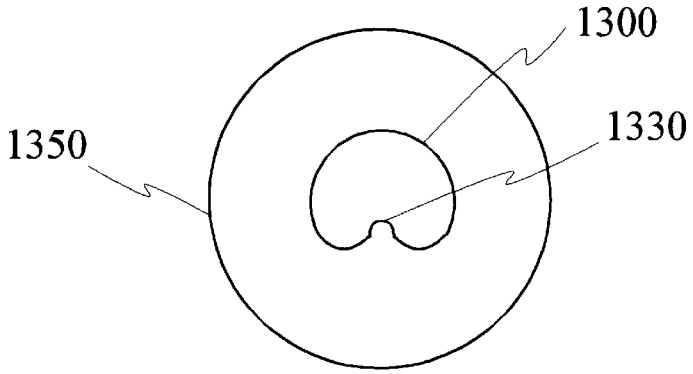
FIG. 13*b* is a top view of the head of the figurine of FIG. 13*a*, showing the keyed hole in the head.
Figure 13C:
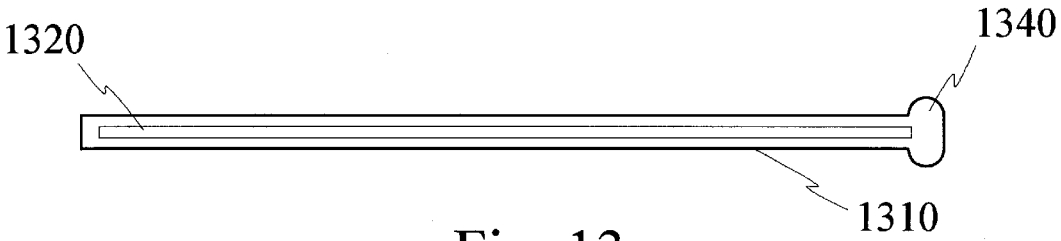
FIG. 13*c* is a side view of the stick of FIGS. 13*a* and 13*b*.

The above implementation uses the figurine in the manner of a stick to impart spin to the top. This implies that the figurine is essentially round in cross-section and has a very narrow diameter. It may be desired to have a more full-bodied figure, in which case the body would be unsuitable for using to spin the top because of its thickness, and its bumpiness. In that case, a stick is required, which may be provided as shown in FIG. 13 by having a hole 1300 down the centre of the figurine in which a stick 1310 is placed. In order to spin the top, the stick is pulled up by grasping the top 1340 of the stick, and a means such as a groove 1320 formed in the stick and tongue 1330 formed in the head 1350 of the figurine is provided to prevent the stick from being pulled completely out of the head 1350. The top may then be spun by hand as previously described, and when the top is released and upon hitting the ground, the stick will then fall down into place within the hole down the centre of the figurine.

The foot 810 of the top is not pointed, but in fact has a small flat bottom 800 in order that the figurine will travel across the surface rather than spin in one place. The small disk like foot thus acts like a wheel on an angle when the top is spinning, so as to simulate a figure skater for example. If the top is set spinning at an angle, the top will roll across the surface in a skating motion. If the spin is a forward spin then the top will advance in a circular arc that will bring the top back to the person who launched it. This disk foot will allow the top to "boomerang" back to the sender.

If the spin is retrograde, then the spinning of the disk will tend to reverse any forward motion of the top. The top will turn around more abruptly and come back. Various tilts of the top will send it moving to the right or the left. It is easy to envisage games of skill being played with a top with a small disk foot. Various targets which may include other tops could be set up. The sender may adjust the direction of spin of the top and the tilt of the top in order to send it on a desired course.

In these embodiments, the portion of the spring projecting below the lower spindle portion may bend sideways upon impact when dropped to avoid the compression caused by the impact. This will have the effect of reducing the jumping motion, as well as impeding the spinning of the toy. This may be reduced in the preferred embodiment by providing means to prevent the spring from avoiding compression upon landing, thus imparting the maximum compressive energy to the toy.

Figure 14:
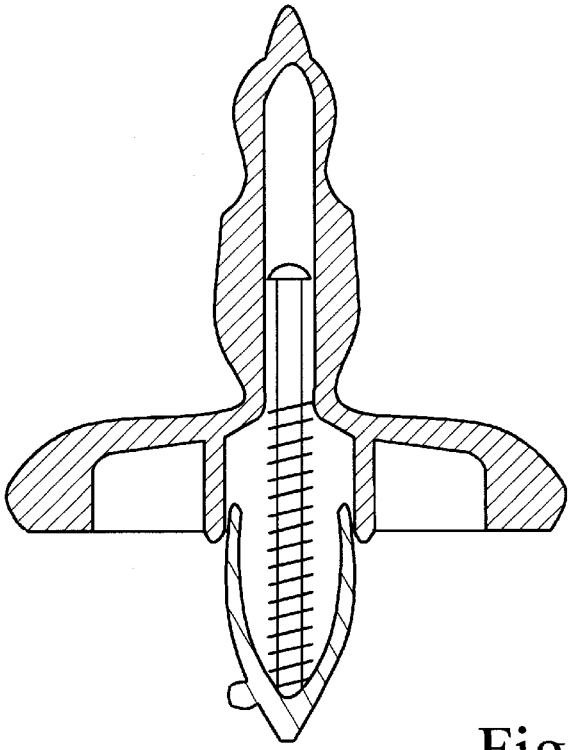
FIG. 14 is a sectional view of a further embodiment of the invention.
Figure 15:
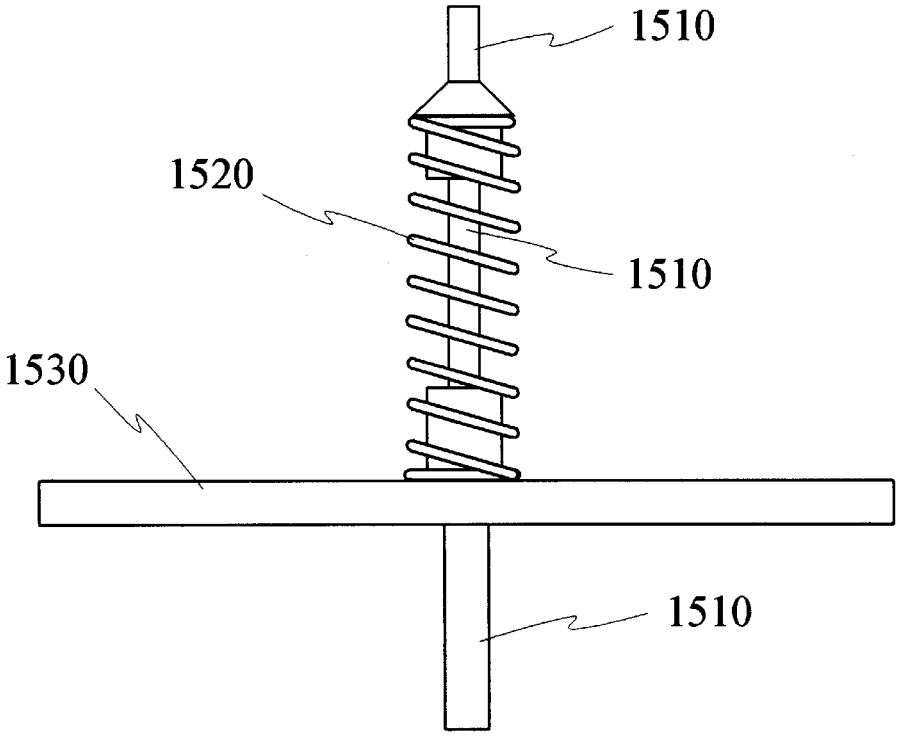
FIG. 15 is a elevation view of a different embodiment of the invention.

As seen in FIGS. 14 and 15, the upper spindle and disc are integrally formed and may be made into the shape of a figurine, for example. The centre of the spindle is hollow, and on the underside of the disc, a circumferential flange is provided around the centre of the disc. This flange may also be formed integrally with the disc and spindle. The flange provides lateral support to assist in keeping the spindle in a vertical position with respect to the disc and upper spindle at all times.

The lower spindle is elongated and fits within the hollow upper spindle. A stop is provided on the end to prevent the lower spindle from coming free of the upper spindle. A spring is fitted loosely over the lower spindle, and the bottom of the lower spindle is attached to a pivot portion. This arrangement permits the spring to be retained loosely on the lower spindle, and permits the lower spindle to move up and down within the upper spindle without causing the spring to bind, while at the same time preventing the spring (and thereby the lower spindle) from moving sideways during movement up and down within the upper spindle.

The end result is a spinning toy which may be spun and dropped from a height onto a play surface, and which will bounce as it spins. With appropriate molding of the upper spindle, the toy can be made to imitate the motion of a figure skater, or ballet dancer for example.

By molding a small bump on the lower portion of the pivot portion as shown in FIGS. 2 and 14, extra hopping motion may be imparted to the toy when the toy is spun at a sufficiently non-perpendicular angle to the surface, by striking the surface once per rotation. As in the previous embodiment, this causes the toy to simulate the motion of a ballet dancer leaping into the air.

In FIG. 15, an alternative to the previous embodiments is shown in which the spring is placed in tension. A spindle 1510 acts as both the foot and the stick for spinning the top. A spring is attached near the top of the spindle, and the disk portion 1530 is attached to the bottom of the spring.

In the embodiment illustrated in FIG. 15, the spring is placed in tension instead of compression. In this embodiment, the top has a central lower aperture located underneath the main body 180. A spindle 184 is provided which may move vertically within the central aperture. Spring 1520 is situated within the lower aperture and is placed over spindle 1510, its axis thereby aligned with the axis of rotation of the top. The spring is secured to the top within the aperture adjacent the bottom of the aperture by any suitable means such as by gluing or molding, and extends upwardly into the central aperture, as shown in FIG. 15. At its upper end, the spring is attached to the spindle, again by any suitable means. This arrangement thereby provides a resilient connection between the spindle 1520 and the body of the top, permitting the top to move vertically up and down within the range of the spring when the top is in use. By dropping the top onto a surface as it is spun, vertical oscillatory motion will be imparted to the body of the top as it spins.

The basic top, including the stick used to spin it as described elsewhere, can be given a different foot design and made to behave like a miniature tornado which is fascinating for children to observe.

Figure 16A:
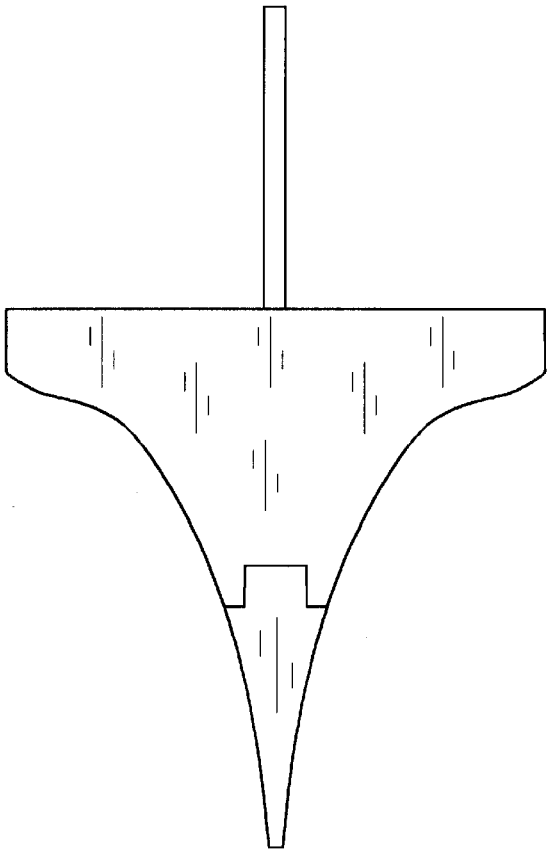
FIG. 16A is an elevation view of a further embodiment of the invention.
Figure 16B:
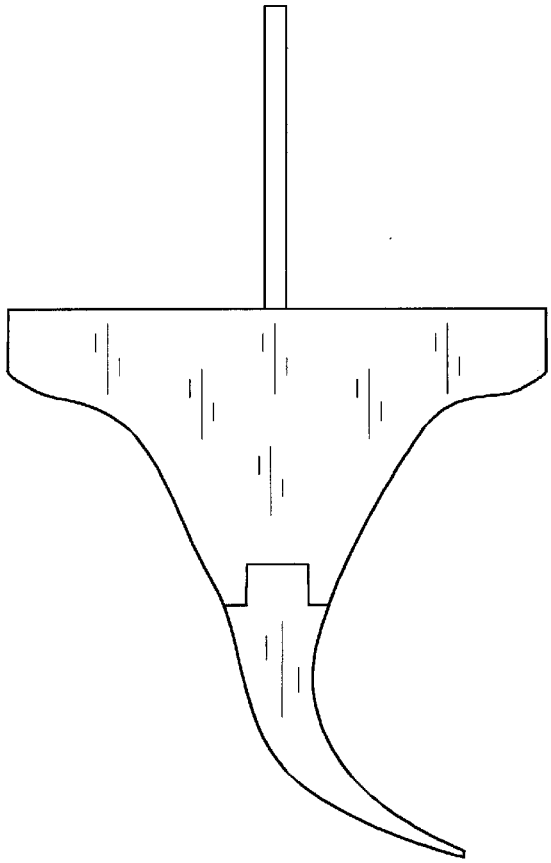
FIG. 16B is an elevation view of the embodiment of FIG. 16A in use.

The basic top described above can be given a flexible foot that is shown in FIG. 16. This foot will buckle partially under the load of the top when it is set spinning on the ground as shown in FIG. 16. The tip of the foot then acts like a cylinder which rolls around on the surface on one end as the disk body of the top spins above it. The motion that the top describes is then very similar to that of a tornado.

In practise the top will be found to have adequate stability when the height of the top not including the stick is no more than the diameter of the disc of the body of the top.

Figure 17:
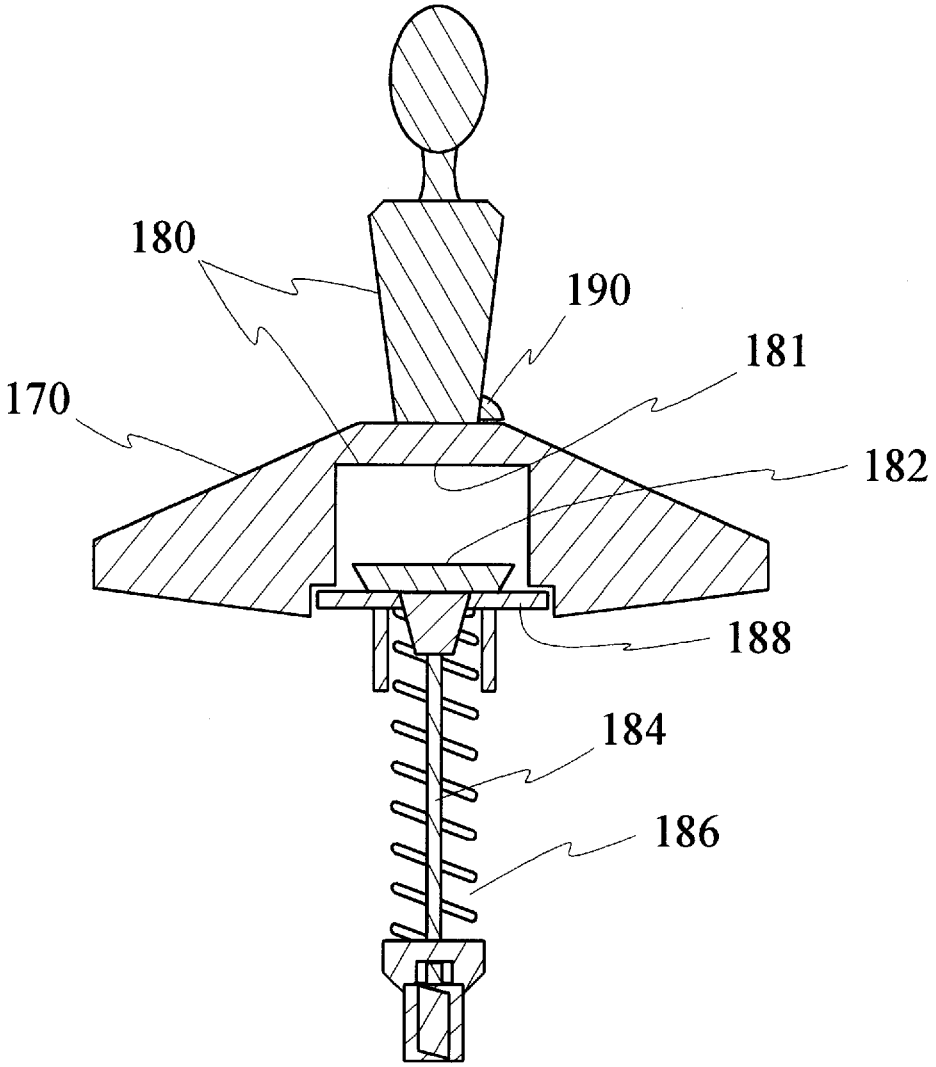
FIG. 17 is a sectional view in elevation of a further embodiment of the invention.

In FIG. 17, a further embodiment of the invention is shown. In this embodiment, the 'skirt' of the top consists of a disk 170 with a round aperture in the middle, through which the 'body' 180 of the doll is passed. Body 180 has a round flange 181 at the bottom, limiting upward movement of the body in the vertical direction with respect to the disk. The round flange is relatively smooth and flat on its bottom so that a suction cup may adhere to it for a period of time. A suction cup 182 is mounted so that it sits upon a supporting disk 188, and is attached to a foot 192 by a string or other flexible means 184. The foot 192 is held apart from the suction cup 182 by means of a spring 186 held in compression by the length of string 184.

In FIG. 17, supporting disk 188 is affixed to skirt 170.

In use, the body of the toy is pushed downwardly until the flange 181 comes into contact with the suction cup 182, and the suction cup is then forced to stick to the bottom of the flange. The user then draws the body of the toy outwardly, causing the suction cup to pull by means of the string on the foot 192, thereby compressing spring 186 further. Body 180 has a tab 190 which is able to pass through a keyed slot in the disk (not shown), after which the body may be twisted with respect to the disk (as shown in FIG. 17*b*), so that the tab 190 will retain the toy in its compressed configuration until the suction cup releases by pressing upon the top of the disk 190.

The toy may now be spun as a spinning dancing top, as discussed earlier, but in addition, when the suction cup releases, the toy will be caused to jump into the air by the release of the spring previously held in compression by the suction cup.

Figure 18A:
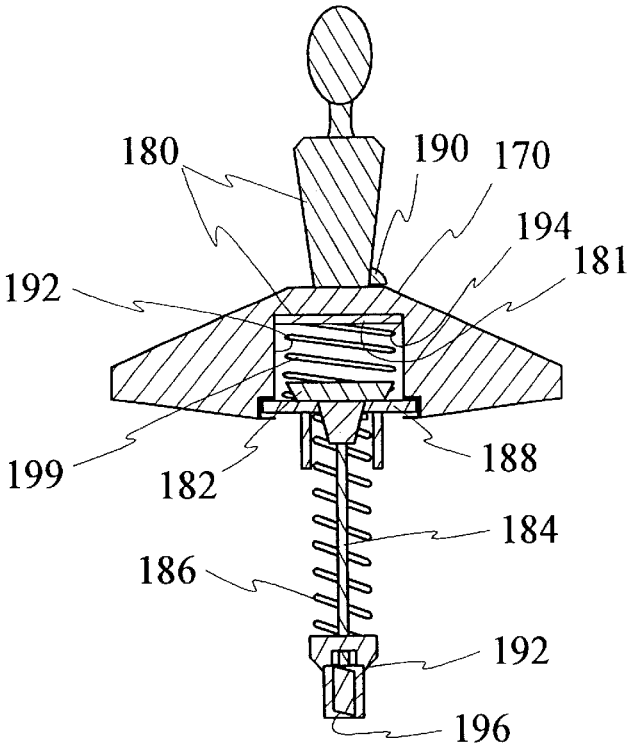
FIG. 18*a* is a sectional view in elevation of a further embodiment of the invention, showing the invention in an uncompressed state.
Figure 18B:
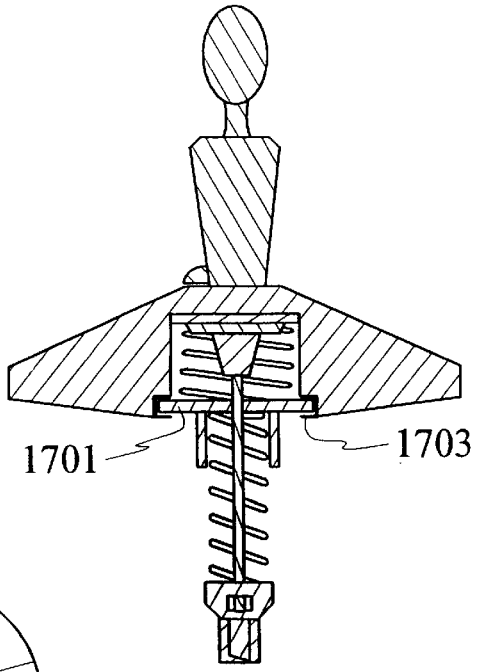
FIG. 18*b* is a sectional view of the embodiment of FIG. 17*a*, showing the invention in a compressed state.

As an alternative, as shown in FIGS. 18*a* and 18*b*, a spring 199 may be provided in addition inside the cavity 192 of the disk and attached near the top to the disk as at 194 and attached to the supporting disk 188, then by choosing an appropriate type of spring, the skirt 170 and body 180 may be rotated several turns with respect to the supporting disk 188. In this case, the foot 196 should be of a nature so that it may be held securely in a holder or other means to prevent it from rotating while allowing it to slide relatively freely up and down (such as a slot in a table). Ideally, the foot should have a non-circular cross section so that it may be mated with a matching hole (not shown) for this purpose.

Figure 18C:
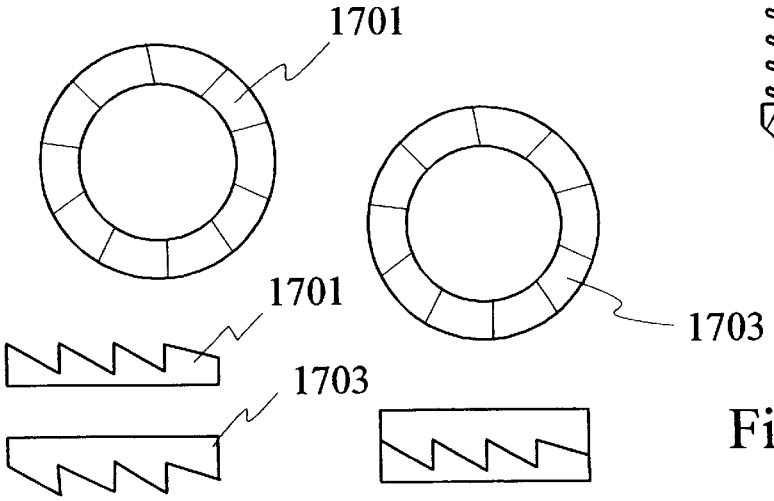
FIG. 18*c* shows the ratcheting mechanism of the embodiment of FIGS. 18*a* and 18*b*.

FIG. 18*c* shows a mechanism to permit the toy to be wound up. A set of ratcheting surfaces 1701 and 1703 are provided on the upper surface of supporting disk 188 and the lower side of the disk 170 respectively. When these two surfaces are engaged, they permit winding of the toy, but prevent unwinding of the toy.

In this case, the toy may then be compressed so that the suction cup engages the flange as before, and the body retracted and tab 190 'locked' to hold the toy in compressed configuration. The toy may then be wound up by twisting the skirt 170 and body 180 several turns with respect to the supporting disk 188. If the foot 196 is then inserted into a mating hole, the foot will not be able to twist. The ratcheting surfaces 1701 and 1703 prevent the spring from unwinding, until the suction cup releases. At that point, spring 186 will cause the body 180 and disk 170 to jump vertically, releasing the ratcheting surfaces 1701 and 1703, thereby also causing the spring 199 to unwind, which in turn will cause the disk 170 and body 180 to rotate rapidly.

Provided that the spring 186 is long enough, the same toy can be spun by hand by rolling the spring rapidly between the users hands, analogously to the embodiments of, for example, FIGS. 1 and 2, except that the spring itself is used as the 'stick' to spin the toy.

The embodiment of FIG. 18 may be played with in a number of ways. It may be spun and dropped as in the embodiment of FIG. 1. Alternatively, it may be compressed and then spun from underneath and dropped such that it bounces initially, then spins and then later pops up when the suction cup releases, and comes down and bounces again, simulating a figure skater for example. Finally, it may also be compressed, wound and placed in a stable holder such that it will spin launch itself into a jump, then bounce and spin. Thus, this embodiment has a number of ways of being played with by children.

It may be desirable for aesthetic reasons and also t reduce the weight of the toy to have a narrower body and a lighter skirt.

For a delayed jumping doll, I then wonder where I can best put the suction cup and I also desire to make the suction cup as small as possible.

For a given spring compression, I would like to reduce the force on the suction and hence the required size of the suction cup as much as possible.

One way to do this is the use of a lever with the short end of the lever connected to the spring and the long end of the lever connected to the spring.

Figure 19B:
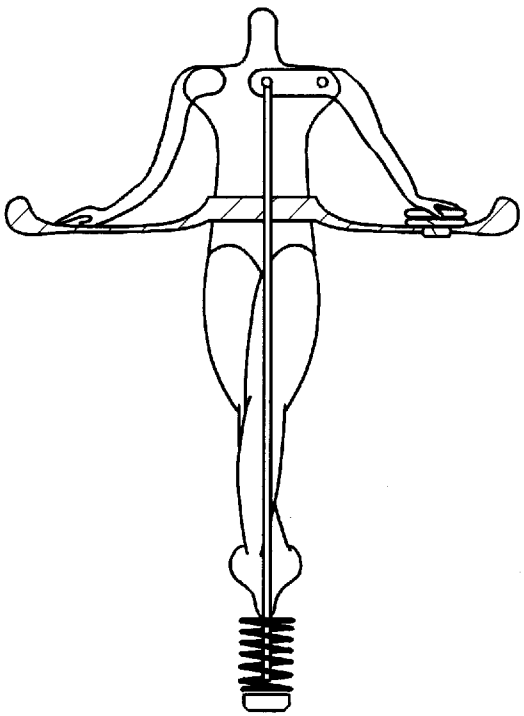
FIG. 19*b* is an elevation view of the embodiment of FIG. 19*a* showing the embodiment in compression.
Figure 19A:
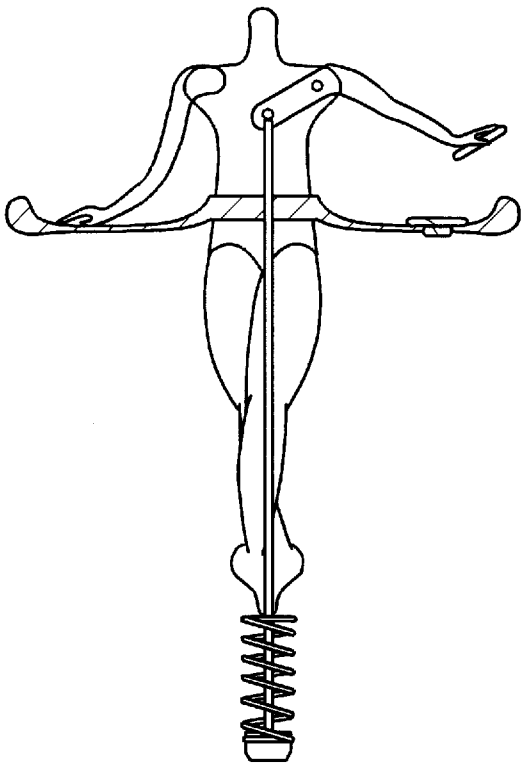
FIG. 19*a* is a partial elevation view partly in section showing a further embodiment of the invention.

In FIG. 19*a*, we see a small cup put into the body of the disc-skirt, a lever made out of the doll's arm and the short end of the lever connected via a flexible tensile member (such as a string) to the bottom of the spring. When the arm is cranked down, it pushes a flat disc held by the hand into the suction cup of the disc-skirt.

The suction cup holds down the hand of the arm thereby holding the spring in compression. The spring is not fully compressed and hence can be used to bounce the doll by dropping it after spinning it.

Incidentally, the doll can be set in spinning motion by rubbing the legs between the user's hands as described above for the stick.

The suction cup is designed to leak and so pop within approximately 30 seconds. When it pops, the arm flies up as shown in FIG. 19*b*, and the spring decompresses, making the doll jump in the air.

The lever arm allows the spring to be compressed easily by the child because it reduces the force required.

This implementation allows a maximally aesthetic looking doll that is very light weight.

FIGS. 20A through 20E show an improved embodiment of the lower spindle and foot of the apparatus which provides numerous advantages to the invention.

Figure 20A:
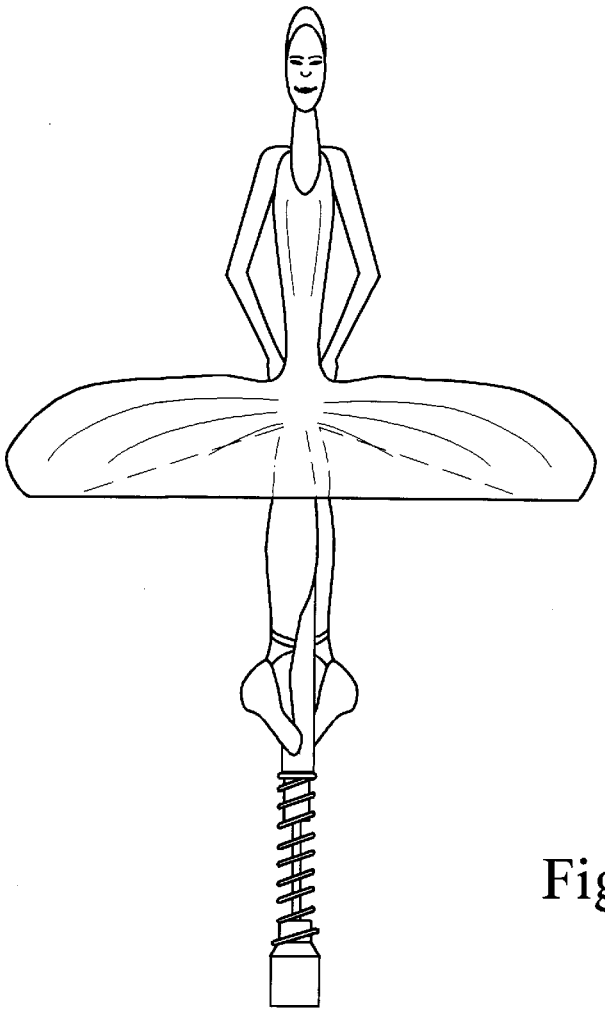
FIG. 20A shows another embodiment of the invention.
Figure 20B:
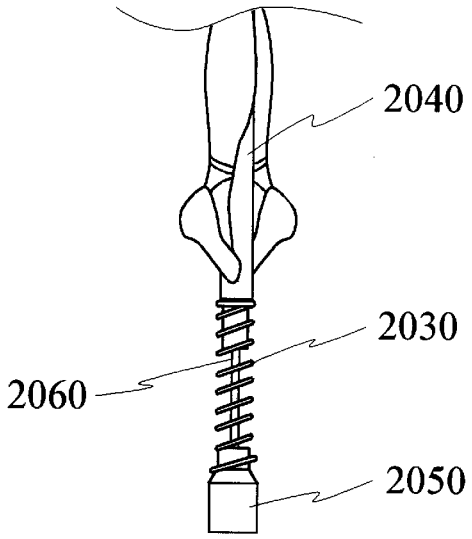
FIG. 20B shows in more detail the foot arrangement of the embodiment of FIG. 20A.
Figure 20C:
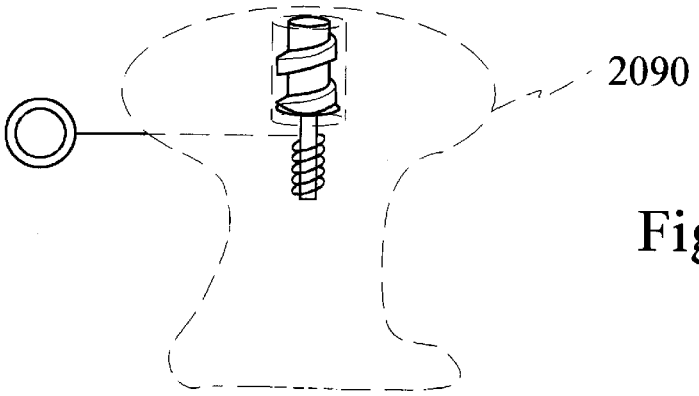
FIG. 20C illustrates the hand launcher for use with the embodiment of FIG. 20A.

FIG. 20A shows the arrangement generally and FIG. 20B shows in more detail the arrangement of the spring and foot. As seen in FIG. 20A, a doll figure having a somewhat disk or cone shaped skirt is fixed onto the lower spindle 2040 which is once again positioned within a spring 2030, which itself is then positioned over a foot 2050 as before. Spring 2030 butts up against a small flange 2042 at the bottom of the dolls toe. The flange 2042 establishes the upper limit of spring motion and prevents the spring from sliding up and down on the doll when the rod is pushed into the doll by the doll's impact with the floor.

The skirt of the doll is preferably made of heavy plastic or similar substance giving the overall doll substantial weight, thereby providing the doll with a significant source of angular momentum when spun.

Figure 20D:
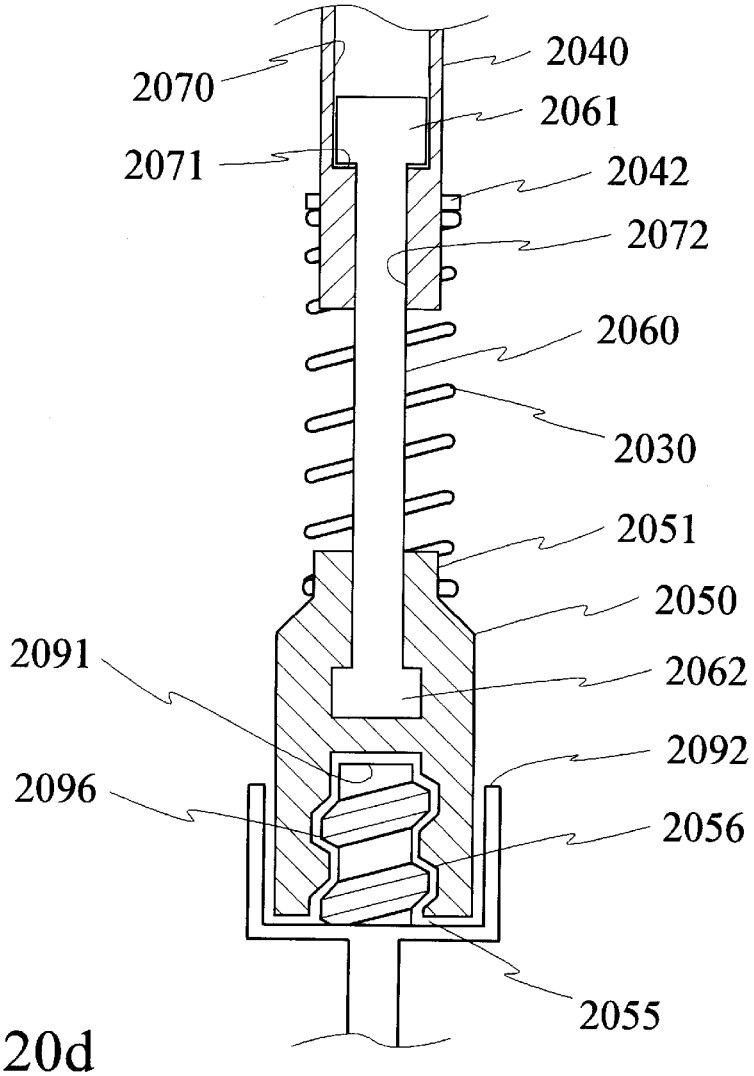
FIG. 20D is an elevational detail view, partly in cross-section, showing with respect to the embodiment of FIGS. 20A through 20C, the arrangement of the rod within the foot, and the means whereby the launcher spindle is able to turn the doll, and to allow the doll to rise out of the launcher and go free when the launcher spindle ceases turning.

As best seen in FIG. 20D, a rectilinear or straight supporting rod 2060 (preferably metal) is located inside of the spring, and is arranged so that it can travel in an axial direction within a bore 2072 in the lower spindle 2040. Approximately an inch above the bottom of the lower spindle, the bore 2072 broadens out into a slot 2070. Shoulder 2071 prevents the rod from exiting from the lower spindle.

In the example shown, slot 2070 is rectangular in cross-section (ie as would be seen from above) and the end of the rod 2061 is given a matching rectangular cross-section so that the rod 2060 cannot rotate relative to the lower spindle. However, any other non-round matching profiles for the slot 2070 and rod end 2061 that would prevent the rod from turning in the slot would suffice.

By this means, rod 2060 can impart torque to the lower spindle by turning, but is free to oscillate up and down within bore 2072 and slot 2070. In order to support the rod within the lower spindle, the rectangular slot commences approximately an inch above the bottom of the lower spindle. This arrangement provides additional strength to the assembly to prevent breaking of the lower spindle where it meets the rod.

At the lower end of the rod 2060, the rod passes through the top of the foot 2050, and ends in a similarly rectangular shaped lower end 2062 around which the foot 2050 is molded. Foot 2050 is thereby fixedly connected to the end 2062 of the rod 2060, and provides a means of coupling torque from a hand launcher 2090 to the rod 2060 and thus to the toy. Spring 2030 bears down upon the upper neck 2051 of the foot to retain the spring in place.

The bottom of the foot 2050 has an aperture 2055 to receive the spindle 2091 of the hand launcher. In addition, molded into the inner surface of the aperture is a spiral thread 2056 sized to loosely engage a matching thread 2096 on the outside of the launcher spindle.

In this embodiment, the toy is used with a hand launcher 2090 having a pull string. When the string is pulled, imparting rapid rotary motion to the spindle in the hand launcher. This in turn is imparted to the end 2080, which couples the torque directly to the rod 2060 and thus to the lower spindle 2040 and the rest of the toy.

It will be noted that the bottom of the foot 2050 is not a single rotation point, as would be the case for a customary top for example. As seen in for example FIG. 20D, the diameter of the foot where it would contact a floor or other surface upon which it spins is significant. By this means, the toy does not spin on a point, but rather rolls around the edge of the bottom lip of the foot.

Therefore, when launched and spinning on a surface, the doll actually rolls as it spins on the foot in a motion that is complicated to describe. The motion is similar to that of a bowl rotating and wobbling on its rim. In the case of the doll, the rim is very small and the wobble is very fast and of small amplitude. Nonetheless the wobble allows the doll foot to roll rather than slide against the floor and it is this effect that allows it to spin for such an extended period. The small wobble also makes the motion more closely imitate the motion of a skater shifting body weight from one side to the other as he or she skates. This shifting or wobble further differentiates the doll from a simple top because the motion is not simply spinning but is spinning while rolling on a rim.

When an angle different from the vertical (by approximately 15 degrees or more) is imparted to the doll during the spin by angling the launcher so that it is not aligned vertically, then the doll will land on an angle and will roll on the rim like a barrel rolling on its rim. This is a true roll, not a mere stationary wobble and the doll in this mode will careen across the floor in a wide arc simulating a skater gliding across the ice. This motion also differentiates the doll from a top which cannot glide across a floor.

As seen in FIG. 20D, the rod 2060 must extend considerably into the interior of the leg of the doll in order not to overstress the plastic of the leg. Otherwise, the impact torque would split the bottom of the leg. A good minimal distance of projection into the interior of the leg is 1" or more. Thus, slot 2070 will start out as a slim round hole or bore for approximately the first 1 inch and then broadens into the rectangular cross-sectional slot described.

Figure 20E:
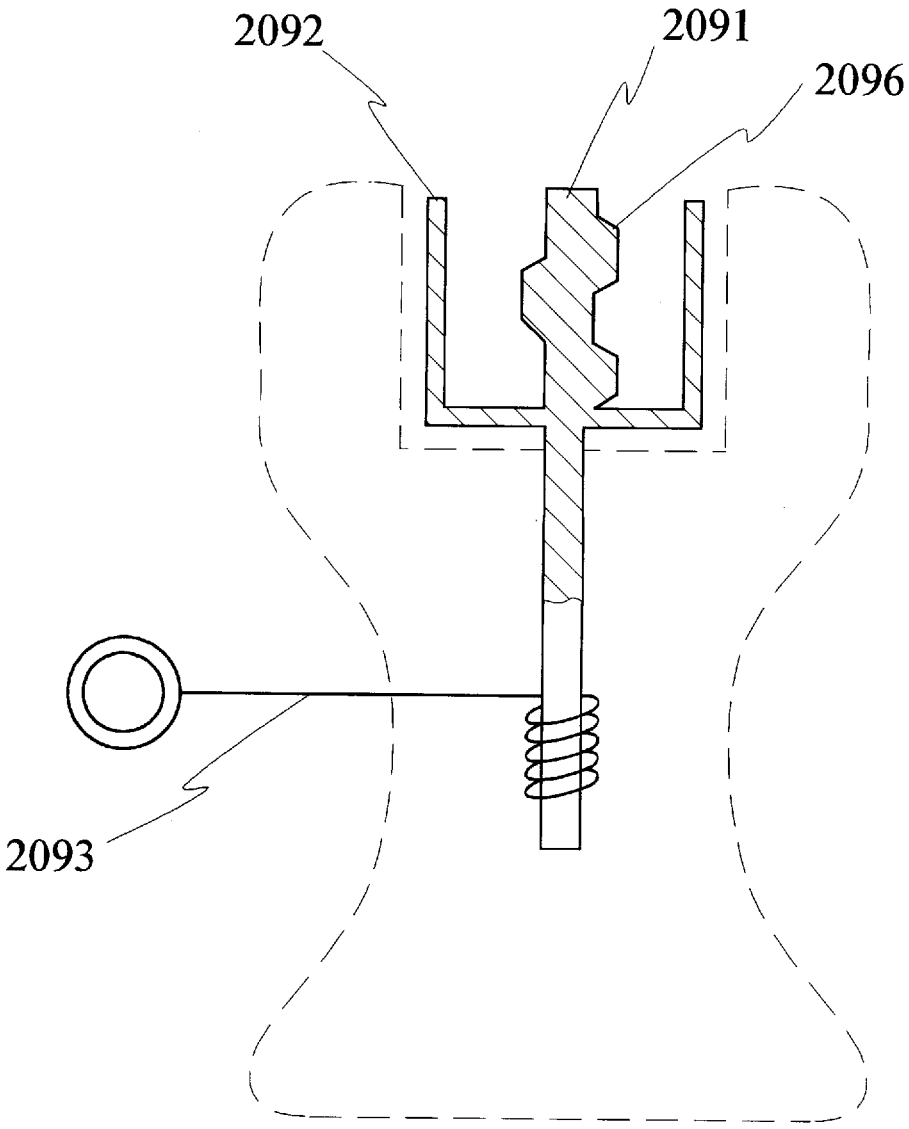
FIG. 20E shows a schematic view of the hand launcher for use with the embodiment of FIG. 20A, showing in outline form only the body of a launcher of conventional design in the toy industry, and showing in partial cross-section the launcher spindle.

As best seen in FIG. 20E, the hand launcher 2090 is similar to the conventional design well-known in the art, and uses a pull string to rotate a small spindle 2091, with a spring return (not shown) to rewind the string after pulling. The spindle 2091 located at the top of the launcher is sized to fit into the aperture 2055 in the foot of the doll when in use. A launcher cup 2092 surrounds the spindle and provides additional support to the doll when it is sitting on the launcher spindle 2091. The spindle is supported within the body of the launcher by conventionally known means in order to permit the pull string 2093 to be pulled, rotating the spindle about its axis, and permitting the string 2093 to be rewound by spring action (not shown) after it has been pulled.

The difference in the design of the hand launcher of this embodiment over the known prior art resides in the manner in which it engages the foot of the doll, and causes the doll to be elevated out of the launcher. Conventional toys which utilise hand launchers have wings which cause the toy when spun to lift itself out of the launcher by aerodynamic means. In the present case, the doll does not have any means of aerodynamic lift.

Therefore, in order to permit the doll to be launched out of the launcher 2090 (ie to rise up from the launcher and spin free of it), there is an externally projecting thread or helix 2096 on the outside of the launch spindle 2091 that engages when twisted within a corresponding helix or internal thread 2056 within the aperture 2055 in the foot of the doll.

When the doll is sitting upon the spindle 2091, pulling the pull string 2093 will cause the threaded spindle 2091 to turn. Because the internal thread 2056 in the foot of the doll is threaded onto the external thread 2096 of the spindle, rotating the spindle will rotate the doll. However, when the pull string reaches the end of its pull and spindle 2091 is no longer being rotated, the doll will be free to continue to rotate, but will be forced by the threads 2056 and 2096 to rise up on the spindle 2091 until it spins free of the spindle 2091. The doll will then be free to fall to the ground to continue spinning.

The size and pitch of the helix must be large enough so that a child can easily insert the foot into the spindle. Ideally, the helix should advance at approximately 30°, and should go around the spindle once or no more than twice as shown. This will permit a child to easily seat the doll upon the spindle without excessive winding or difficulty.

The depth of the helix (ie the height to which it rises on spindle 2091) is great enough that the foot will lift the doll out of the launching cup 2092 in the launcher at the end of the pull of the launch string 2093. If the helix were not deep enough, the foot would not be lifted sufficiently to free the doll from the launcher and the doll would rotate as a captive in the launch cup 2092 in the launcher. The height of the helix in the launcher must extend close to or even beyond the rim of the launch cup in order that the doll may spin the rotator cup up around the ramp of the helix using the rotation energy of the spinning doll high enough to clear the rim of the launch cup in the launcher.

Similarly in the foot of the doll, the ramp of the helix must extend far enough downwardly to allow the lower rim of the foot to clear the ramp of the helix of the launcher. The depth of the internal aperture of the foot (and the corresponding spindle 2091) must also be deep enough to support the doll while it is being spun. Generally a depth of ⅜ths to ½ inch has been found to be adequate for this lateral support during the spinning and launching process. The tip of the spindle 2091 should be at a minimum flush with the rim of the launcher cup 2092 and could extend ⅛th of an inch beyond to impart more of a lift to get the doll out of the launcher cup 2092 after the string has been pulled.

Providing a rod within the spring in the fashion described herein provides a number of advantages. The toy is relatively heavy because of the skirt. Because of this weight, it is advantageous to provide support for the spring to keep if from collapsing, and thus reducing the length of spin. By providing a larger foot, the toy is better adapted to be landed on a floor without causing marring of the floor due to the impact.

The spring is necessary for two primary reasons. The doll can imitate a dancer or a skater and jumps when launched and falls on the ground from a height-ie it bounces several times using the spring. The requirement for the disc of the skirt to have substantial weight so that it can store enough energy to spin for a long time combined with the requirement for the doll to spin on a small surface area plus the fact that it is launched sometimes at a height in order to bounce means that the doll requires shock absorption. If the doll did not have a spring shock absorber attached to its foot where the doll touches the supporting surface, the doll might otherwise shatter when it lands on a hard surface and could damage softer surfaces like wooden floors on impact.

The spring must be thin enough to flex and also to bounce the doll. In practice, this can mean that the optimum size and shape of spring could be too wobbly from side to side to support the doll both when it lands and when it is launched by the launcher that imparts rotation to the doll's foot. In experiments, it has been determined that the doll would land and the unsupported spring would slip out laterally under the doll and not provide adequate shock absorption. This problem was especially prevalent when the doll landed on slippery surfaces which allowed the spring to escape to the side more readily. Similarly, this slippage of an unsupported spring also did not allow the doll to bounce several times, simulating jumping. An unsupported spring also caused problems during the launch. When the string was pulled thereby rotating the foot of the doll, the doll would begin to rotate. However, if the doll was not adequately supported by the spring, it would rapidly begin to wobble sideways excessively which would prevent it from being spun rapidly and launched properly.

To correct these problems, the spring must therefore be supported so that it cannot move laterally but can only move into and out of the base of the doll as shown in FIG. 20D. It has been found that one of the best ways to support the spring is to attach the foot of the doll to a rod that was free to move into and out from the bottom of the doll's feet and legs. This rod attaches to the foot 2050 of the doll fixedly. When the foot is spun to spin the doll, it must be able to impart torque to the doll. This is accomplished by having the end of the rod terminate in a rectangular block for example that can slide in and out of the doll in a slot of rectangular cross-section. Such a rod can move in and out of the doll but cannot be rotated within the doll and is thus able to transmit the torque from the foot to the doll allowing it to spin. The rod also does not allow significant lateral motion and hence can be used to stabilize the spring. The spring is placed between the bottom of the lower spindle and the foot of the doll as shown in FIG. 20B. The spring is used to allow shock absorption and bouncing but not to transmit torque or to substantially resist sideways forces, both functions which are fulfilled by the rod.

When the doll of this embodiment is combined with the hand launcher described, a novel toy is produced which is capable of being spun at great rotational speed, launching itself free of the hand launcher, and bouncing and rolling or spinning upon landing on a flat surface in the manner of a figure skater.

I claim:

1. A spinning toy comprising a spinning body capable of spinning like a top about an axis of rotation and having a bottom having a central region adjacent the axis of rotation;

spring means fastened to the spinning body and extending below a point at or near the central region of the spinning body, the spring means aligned generally with the axis of rotation of the spinning body to absorb compressive force in the direction of the axis of rotation of the toy;

foot means attached to a bottom end of the spring means and located below the spring means when the toy is in use, the foot means having a bottom end having a flat circular rim around its periphery to permit the toy to roll upon a surface when the spinning body is spinning, the diameter of the flat circular rim being sufficiently large to permit the foot of the spinning body to roll upon the rim as it spins thereby causing the toy to move laterally when in use:

a generally circular, vertical extending bore in the bottom surface of the foot means, the bore having a first helical thread formed therein;

a hand-operated launcher means for spinning the spinning body and launching it onto the surface, the launcher means comprising a launcher body adapted to be held in a hand of a user, a spindle means vertically mounted in the launcher body, capable of rotation about its vertical axis and having an upper end accessible through an opening in a top surface of the launcher body and extending relatively close to or protruding slightly above the top surface of the launcher body, a pull-string wrapped around the spindle means so that pulling on the pull-string causes the spindle means to rotate about its vertical axis, a second helical thread located at the upper end of the spindle means and adapted to thread loosely into the first helical thread within the vertically extending bore in the foot means, whereby when the pull-string is pulled causing the spindle means to rotate, the first helical thread securely engages the second helical thread, causing the foot means and thereby the spinning toy to rotate, and when the spindle means stops rotating the foot will continue to rotate, due to the angular momentu the first helical thread to unthread itself from the second helical thread, and thereby tending to cause the foot means and thus the spinning top to rise out of the launcher.

2. The toy of claim 1, further comprising:

a rectilinear support rod having a top end and a bottom end and attached fixedly at its top end within the spinning body along the axis of rotation and protruding below the spinning body, the support rod having a non-circular cross-section near its bottom end, wherein an upper end of said spring means is in contact with the bottom of the spinning body and wherein said spring means is wrapped closely around the protruding rectilinear rod such that the spring means can compress along the support rod, the foot means having a top portion having a hole centrally located along an axis of rotation, the hole having a cross-section that closely matches the non-circular cross-section near the bottom end of the support rod, the foot means being positioned below the spring means and in contact with the spring means and positioned such that the support rod fits into the hole in the foot means and the foot means can move upward along the support rod to compress the spring means but is not able to rotate with respect to the support rod;

means for retaining the support rod within the foot means at all times.

3. A spinning toy comprising a spinning body capable of spinning like a top about an axis of rotation and having a bottom having a central region adjacent the axis of rotation;

spring means fastened to the spinning body and extending below a point at or near the central region of the spinning body, the spring means aligned generally with the axis of rotation of the spinning body to absorb compressive force in the direction of the axis of rotation of the toy;

foot means attached to a bottom end of the spring means and located below the spring means when the toy is in use, the foot means having a bottom having a flat circular rim around its periphery to permit the toy to roll upon a surface when the spinning body is spinning, the diameter of the flat circular rim being sufficiently large to permit the foot of the spinning body to roll upon the rim as it spins thereby causing the toy to move laterally when in use;

rectilinear support rod located within the spring means between the foot means and the spinning body, the support rod being fixedly attached to the foot means, having an upper portion having a non-circular cross-section, and having a length sufficient to protrude into the body at all times;

an aperture in the bottom of the spinning body having a non-circular cross-section corresponding to the cross-section of the upper portion of the support rod to receive the support rod such that the support rod may move relatively freely only in the direction of the axis of the support rod but may not rotate with respect to the support rod when the toy is being launched; and rod retention means for retaining the upper end of the support rod within the aperture at all times.

4. The toy of claim 3, further including a generally circular, vertically extending bore in the bottom surface of the foot means, the bore having a first helical thread formed therein;

a hand-operated launcher means for spinning the spinning body and launching it onto the surface, the launcher means comprising a launcher body adapted to be held in a hand of a user, a spindle means vertically mounted in the launcher body, capable of rotation about its vertical axis and having an upper end accessible through an opening in a top surface of the launcher body and extending relatively close to or protruding slightly above the top surface of the launcher body, a pull-string wrapped around the spindle means so that pulling on the pull-string causes the spindle means to rotate about its vertical axis, a second helical thread located at the upper end of the spindle means and adapted to thread loosely into the first helical thread within the vertically extending bore in the foot means, whereby when the pull-string is pulled causing the spindle means to rotate, the first helical thread securely engages the second helical thread, causing the foot means and thereby the spinning toy to rotate, and when the spindle means stops rotating, the foot will continue to rotate due to the angular momentum of the spinning toy, causing the first helical thread to unthread itself from the second helical thread, and thereby tending to case the foot means and thus the spinning top to rise out of the launcher.

5. A spinning toy comprising a spinning body capable of spinning like a top about an axis of rotation and having a bottom having a central area adjacent the axis of rotation;

spring means fastened to the spinning body and extending below a point at or near the central area of the spinning body, the spring means aligned generally with the axis of rotation of the spinning body to absorb compressive force in the direction of the axis of rotation of the toy;

foot means attached to a bottom end of the spring means and located below the spring means when the toy is in use, the foot means having a bottom having a flat circular rim around its periphery to permit the toy to roll upon a surface when the spinning body is spinning, the diameter of the flat circular rim being sufficiently large to permit the foot of the spinning body to roll upon the rim as it spins thereby causing the toy to move laterally when in use;

a rectilinear support rod located within the spring means between the foot means and the spinning body, the support rod being fixedly attached to the foot means, having an upper portion having a non-circular cross-section, and having a length sufficient to protrude into the body at all times;

an aperture in the bottom of the spinning body sized to receive the support rod such that the support rod may move relatively freely only in the direction of the axis of the support rod;

a slot communicating with the aperture into which the support rod projects within the spinning body, the slot having a cross-section of a size and shape to receive the upper end of the support rod so that the support rod may move freely in the direction of the axis of the support rod, but may not rotate with respect to the spinning body;

rod retention means for retaining the upper end of the support rod within the aperture at all times;

a generally circular, vertically extending bore in the bottom surface of the foot means, the bore having a first helical thread formed therein;

a hand-operated launcher means for spinning the spinning body and launching it onto the surfaces, the launcher means comprising a launcher body adapted to be held in a hand of a user, a spindle means vertically mounted in the launcher body, capable of rotation about its vertical axis and having an upper end accessible through an opening in a top surface of the launcher body and extending relatively close to or protruding slightly above the top surface of the launcher body, a pull-string wrapped around the spindle means so that pulling on the pull-string causes the spindle means to rotate about its vertical axis, a second helical thread located at the upper end of the spindle means and adapted to thread loosely into the first helical thread within the vertically extending bore in the foot means, whereby when the pull-string is pulled causing the spindle means to rotate, the first helical thread securely engages the second helical thread, causing the foot means and thereby the spinning toy to rotate, and when the spindle means stops rotating, the foot will continue to rotate due to the angular momentum of the spinning toy, causing the first helical thread to unthread itself from the second helical thread, and thereby tending to case the foot means and thus the spinning top to rise out of the launcher.

* * * * *